United States Patent [19]

Ikeda

[11] Patent Number: 4,983,568

[45] Date of Patent: Jan. 8, 1991

[54] THERMOSENSITIVE RECORDING MATERIALS

[75] Inventor: Mitsuhiro Ikeda, Abiko, Japan

[73] Assignee: Mitsubishi Paper Mills Limited, Tokyo, Japan

[21] Appl. No.: 413,862

[22] Filed: Sep. 28, 1989

[30] Foreign Application Priority Data

Sep. 29, 1988 [JP] Japan ..... 63-246751

[51] Int. Cl.[5] ..... B41M 5/18

[52] U.S. Cl. ..... 503/208; 503/209; 503/217; 503/225

[58] Field of Search ..... 427/150–152; 503/208, 209, 216, 217, 225, 221

[56] References Cited

FOREIGN PATENT DOCUMENTS 2160279 7/1987 Japan ..... 503/209

*Primary Examiner*—Bruce H. Hess

*Attorney, Agent, or Firm*—Cushman, Darby & Cushman

[57] ABSTRACT

There is disclosed a thermosensitive recording material comprising an ordinarily colorless or slightly colored dye precursor, an electron receptive compound (developer) coloring said dye precursor by reacting when heated, and a compound of following general formula (I)

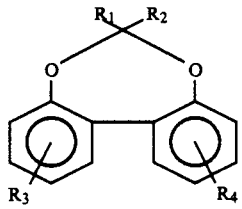

(I)

wherein $R_1$ and $R_2$ each represents hydrogen atom, alkyl, alkenyl or aryl group, and $R_1$ and $R_2$ may be different from each other; may also be linked together to form cycloalkyl, cycloether, and the like; and $R_3$ and $R_4$ each represents hydrogen atom, alkyl, alkenyl, alkoxy or aryl group and halogen atom, and $R_3$ and $R_4$ may be different from each other.

7 Claims, No Drawings

THERMOSENSITIVE RECORDING MATERIALS

BACKGROUND OF THE INVENTION

1. Field of the Invention

The present invention relates to thermosensitive recording materials and in particular relates to thermosensitive recording materials having excellent thermal response.

2. Related Art

Thermosensitive recording materials are generally composed of a substrate having provided thereon a thermosensitive recording layer containing as major constituents an ordinarily colorless or slightly colored dye precursor and an electron receptive developer. Upon being heated by means of a thermal head, thermal pen or laser beam, the dye precursor instantaneously reacts with the developer to form a recorded-image, as disclosed in Japanese Pat. Examined Publication Nos. 43-4160, 45-14039, etc. Because of the advantages of the relatively simple design of devices, ease of maintenance and making no noise, the recording devices employing such thermosensitive recording materials are being used in a wide field including recording instruments for measurements, facsimiles, printers, terminal devices for computers, labels, and automatic vending machines for railroad tickets and the like. Particularly in the field of facsimiles, demand for thermal sensitive devices has been greatly increased and the performance of facsimiles has been raised to high speed and the size of such devices has become very small due to reductions in transmission costs. Facsimiles have been reduced in cost and energy consumption has been lowered. In response to such high speeds and low energy performance required for facsimiles, high sensitivity has been demanded for thermosensitive recording materials. For high speed recording, formation of recorded images utilizing as high efficiency as possible small thermal energy liberated from a thermal head in very short time (generally less than 1 m sec) to color-forming reaction are necessary.

As a way to achieve the above-mentioned purpose the simultaneous use of a dye precursor and electron receptive compound capable of developing color of said dye precursor with a heat meltable substance having relatively low melting point as a coloring accelerator or a sensitizer has been proposed. It is proposed in Japanese Pat. application KOKAI (Laid-Open) Nos. 57-64573 and 58-87094 to use naphthol derivatives, Nos. 57-64592, 57-185187, 57-191085, 58-110289 and 59-15393 to use naphthoic acid derivatives, Nos. 58-72499 and 58-87088 to use ether or ester derivatives of a phenol compound.

However, thermosensitive recording materials produced by any one of the above methods are not still fully satisfactory in thermal response or the color-forming property.

SUMMARY OF THE INVENTION

An object of the present invention is to provide thermosensitive recording materials having good thermal response and high coloring sensitivity.

The present inventors have discovered that thermosensitive recording materials having good thermal response and high coloring sensitivity can be obtained by containing compounds represented by the following general formula, i.e., acetal or ketal compounds in thermosensitive recording materials containing an ordinarily colorless or slightly colored dye precursor and an electron receptive developer capable of developing said dye precursor upon heating and have accomplished the present invention.

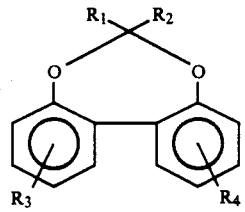

(I)

wherein each of $R_1$ and $R_2$ represents hydrogen atom, alkyl, alkenyl or aryl group, and $R_1$ and $R_2$ may be different from each other; $R_1$ and $R_2$ may also be linked together to form cycloalkyl, cycloether, and the like; each of $R_3$ and $R_4$ represents hydrogen atom, halogen atom, alkyl, alkenyl, alkoxy or aryl group, and $R_3$ and $R_4$ may be different from each other.

DETAILED DESCRIPTION OF PREFERRED EMBODIMENT

As concrete examples of compounds of present invention, for example, the compound represented by the formula are illustrated as follows: which should not, of course, be considered to limit the invention.

formula (1)

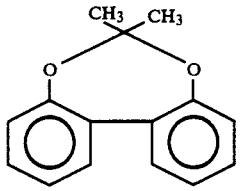

(m.p. 77.5–78.5° C.)

formula (2)

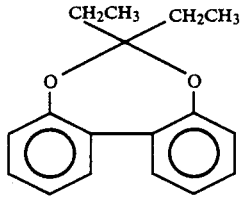

(m.p. 89–90° C.)

formula (3)

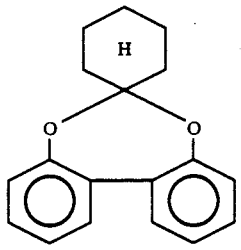

(m.p. 67–68° C.)

formula (4)

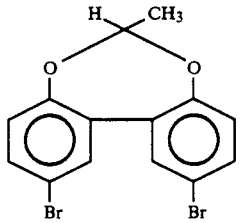

(m.p. 90–91° C.)

-continued formula (5)

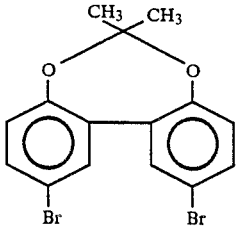

(m.p. 131–132° C.)

formula (6)

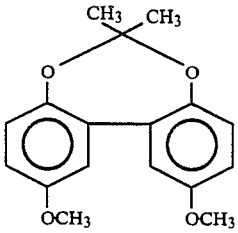

(m.p. 154–154.5° C.)

formula (7)

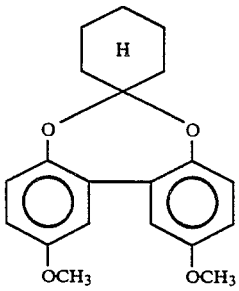

(m.p. 135–136° C.)

formula (8)

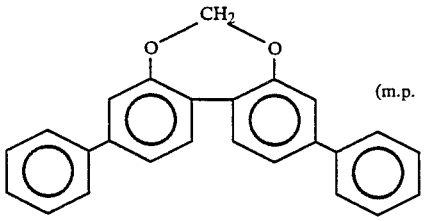

(m.p. 148–149° C.)

Among illustrated compounds are preferable the compounds of formulae (1), (2), (4) and (5).

It is preferable to use compounds having melting point within range of 60°–160° C. for thermosensitive recording materials in practical use.

The compound of present invention is generally added to the developer in the range within 5–400% by weight, but especially adding of 20–300% by weight is preferred. If its amount is smaller than 5% by weight, heat responsibility are unsatisfactory. If its amount exceeds 400% by weight, the amount of thermally fusible matter deposited on thermal head, etc. increases, which can make a trouble on the printing process. Moreover, the compounds can be synthesized easily by well known methods and also purified easily. For example, well known synthetic methods of the present ketal or acetal compounds are given in the following reaction schemes (1)–(4). Further, many other known methods are also usable.

(1) The ketal or acetal compounds can be obtained by transacetalization or transketalization which reacts other acetal or ketal compounds with an alcohol, a phenol or a diphenol or derivatives of these by use of an acid catalyst in general. Thioacetal or thioketal compounds can also be transacetalized or transketalized to produce ketal or acetal compounds by use of mercuric oxide as a catalyst (reaction Scheme I).

(2) The ketal or acetal compounds can be obtained by reaction of a dihalide, e.g. dibromomethane, dibromopropane etc. with an alcohol, a phenol or a diphenol or derivatives thereof in the presence of a base (reaction Scheme II).

(3) The ketal or acetal compounds can be obtained by addition of an alcohol, a phenol or a diphenol or derivatives thereof to the compound having double bond or triple bond. This reaction is carried out generally using an acid catalyst (reaction Scheme III).

(4) The ketal or acetal compounds can be obtained by reaction of carbonyl compound such as an aldehyde or a ketone with an alcohol, a phenol or a diphenol or derivatives thereof. This reaction is carried out generally using an acid catalyst and removing water (reaction Scheme IV).

(reaction Scheme I)

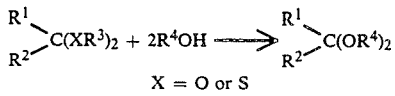

X = O or S (reaction Scheme II)

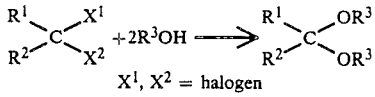

$X^1$, $X^2$ = halogen (reaction Scheme III)

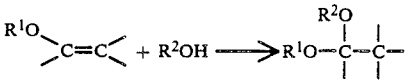

(reaction Scheme IV)

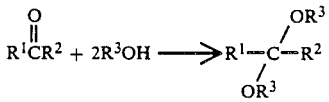

Next, a concrete example of a process for preparing thermosensitive recording materials according to the present invention is described.

Thermosensitive recording materials are prepared by methods described in Japanese Pat. Examined Publication Nos. 43-4160, 45-14039, etc. Namely, thermosensitive recording materials may be generally composed of a substrate having provided thereon a thermosensitive recording layer containing as major constituents an ordinarily colorless or slightly colored dye precursor, an electron receptive compound and a compound according to the present invention. Upon being heated by means of a thermal head, thermal pen or laser beam, the dye precursor instantaneously reacts with the electron receptive compound to form a recorded image. To the thermosensitive recording layer may also be added a pigment, sensitizer, antioxidant, adhesion preventer according to necessity.

Dye precursors used in the present invention are not particularly limited as long as they can be generally used for pressure-sensitive recording paper or thermosensitive recording paper. Specific examples include the following dye precursors.

(1) Triarylmethane Compounds 3,3-bis(p-dimethylaminophyenyl)-6-dimethylaminophthalide (Crystal Violet lactone),
3,3-bis(p-dimethylaminophenyl)phthalide,
3-(p-dimethylaminophenyl)-3-(1,2-dimethylindol-3-yl)phythalide,
3-(p-dimethylaminophenyl)-3-(2-methylindol-3-yl)phthalide,
3-(p-dimethylaminophenyl)-3-(2-phenylindol-3-yl)phthalide,
3,3-bis(1,2-dimethylindol-3-yl)-5-dimethylaminophthalide,
3,3-bis(1,2-dimethylindol-3-yl)-6-dimethylaminophthalide,
3,3-bis(9-ethylcarbazol-3-yl)-5-dimethylaminophthalide,
3,3-bis(2-phenylindol-3-yl)-5-dimethylaminophthalide,
3-p-dimethylaminophenyl-3-(1-methylpyrrol-2-yl)-6dimethylaminophthalide, etc.

(2) Diphenylmethane Compounds 4,4'-bis-dimethylaminophenyl benzhydryl benzyl ether, N-halophenyl leuco Auramine, N-2,4,5-trichlorophenyl leuco Auramine etc.

(3) Xanthene Compounds

Rhodamine B anilinolactam, Rhodamine B p-chloroanilinolactam, 3-diethylamino-7-dibenzylaminofluorane, 3-diethylamino-7-octylaminofluorane, 3-diethylamino-7-phenylfluorane, 3-dimethylamino-7-chlorofluorane, 3-diethylamino-6-chloro-7-methylfluorane, 3-diethylamino-7-octylaminofluorane, 3-diethylamino-7phenylfluorane, 3-diethylamino-7-chlorofluorane, 3-diethylamino-6-chloro-7-methylfluorane, 3-diethylamino7-(3,4-dichloroanilino)-fluorane, 3-diethylamino-7-(2-chloroanilino)fluorane, 3-diethylamino-6-methyl-7-anilinofluorane, 3-(N-ethyl-N-tolyl)-amino-6-methyl-7-anilinofluorane, 3-piperidino-6-methyl-7-anilinofluorane, 3-(N-ethyl-N-tolyl)-amino-6-methyl-7-phenethylfluorane, 3-diethylamino-7-(4-nitroanilino)-fluorane, 3-dibutylamino-6-methyl-7-anilinofluorane, 3-(N-methyl-N-propyl)amino-6-methyl-7-anilinofluorane, 3-(N-ethyl-N-isoamyl)amino-6-methyl-7-anilinofluorane, 3-(N-methyl-N-cyclohexyl)amino-6-methyl-7-anilinofluorane, 3-(N-ethyl-N-tetrahydrofuryl)amino-6-methyl-7-anilinofluorane, etc.

(4) Thiazine compounds

Benzoyl leuco methylene blue, p-nitrobenzoyl leuco methylene blue, etc.

(5) Spiro compounds 3-methyl-spiro-dinaphthopyran, 3-ethyl-spiro-dinaphthopyran, 3,3'-dichloro-spiro-dinaphthopyran, 3-benzyl-spiro-dinaphthopyran, 3-methylnaphtho-(3-methoxybenzo)spiro-pyran, 3-propyl-spiro-benzopyran, etc. These dye precursors can be used singly or as admixtures of two or more.

As dye developers used in the present invention, electron receptive compounds generally employed for thermosensitive paper can be used; in particular, phenol derivatives, aromatic carboxylic acid derivatives, N,N'-diarylthiourea derivatives, polymetal salt such as zinc salt, etc. of organic compounds are used. Among them, particularly preferred ones are phenol derivatives. Specific examples can be p-phenylphenol, p-hydroxyacetophenone, 4-hydroxy-4'-methyldiphenylsulfone, 4-hydroxy-4'-isopropoxydiphenylsulfone, 4-hydroxy-4'-benzensulfonyloxydiphenylsulfone, 1,1-bis(p-hydroxyphenyl)propane, 1,1-bis(p-hydroxyphenyl)pentane, 1,1-bis(p-hydroxyphenyl)hexane, 1,1-bis(p-hydroxyphenyl)cyclohexane, 2,2-bis(p-hydroxyphenyl)propane, 2,2-bis(p-hydroxyphenyl)hexane, 1,1-bis(p-hydroxyphenyl)-2-ethylhexane, 2,2-bis(3-chloro-4-hydroxyphenyl)propane, 1,1-bis(p-hydroxyphenyl)-1-phenylethane, 1,3-di[2-(p-hydroxyphenyl)-2-propyl]-benzene, 1,3-di[2-(3,4- dihydroxyphenyl)-2-propyl]benzene, 1,4-di[2-(p-hydroxyphenyl)-2-propyl]benzene, 4,4'-dihydroxydiphenyl ether, 4,4'-dihydroxydiphenylsulfone, 2,2'-bis(p-hydroxyphenylthio)diethyl ether, bis(p-hydroxyphenylthioethyloxy)methane, 3,3'-dichloro-4,4'-dihydroxydiphenylsulfone, 3,3'-diallyl-4,4'-dihydroxydiphenylsulfone, 3,3'-dichloro-4,4'-dihydroxydiphenylsulfide, methyl 2,2-bis(4-hydroxyphenyl)acetate, butyl 2,2-bis(4-hydroxyphenyl)acetate, 4,4'-thiobis(2-5-butyl-5methylphenol), benzyl p-hydroxybenzoate, chlorobenzyl p-hydroxybenzoate, propyl p-hydroxybenzoate, butyl p-hydroxybenzoate, dimethyl 4-hydroxyphthalate, benzyl gallate, stearyl gallate, salicylanilide, 5-chlorosalicylanilide, etc.

Binders which can be used in the present thermosensitive recording materials include water soluble adhesives such as starches, hydroxyethyl cellulose, methyl cellulose, carboxymethyl cellulose, gelatin, casein, polyvinyl alcohol, modified polyvinyl alcohol, sodium polyacrylate, acrylic amide/acrylate copolymer, acrylamide/acrylate/methacrylate ternary copolymer, alkali salts of styrene/maleic anhydride copolymer, alkali salts of ethylene/maleic anhydride copolymer, etc.; latexes such as polyvinylacetate, polyurethane, polyacrylates, styrene/butadiene copolymer, acrylonitrile/butadiene copolymer, methyl acrylate/butadiene copolymer, ethylene/vinyl acetate copolymer, etc.

Further, additives used in the present invention contain waxes such as N-hydroxymethylstearic amide, stearic amide, palmitic amide, etc.; naphthol derivatives such as 2-benzyloxynaphthalene, etc.; biphenyl derivatives such as p-benzylbiphenyl, 4-allyloxybiphenyl, etc.; polyether compounds such as 1,2-bis(3-methylphenoxy)-ethane, 2,2'-bis(4-methoryphenoxy)diethyl ether, bis(4-methoxyphenyl)ether, etc.; a carbonate or oxalate diester derivatives such as diphenyl carbonate, dibenzyl oxalate, di(p-fluorobenzyl)oxalate, etc. for purpose of further improving the sensitivity.

As a preferable combination of the leuco dye and the electron receptive compound can be illustrated the combination of 3-dibutylamino-6-methyl-7-anilinofluoran and 1,1-bis(p-hydroxyphenyl)propane.

Pigments used in the present invention include diatomaceous earths, talc, kaolin, calcined kaolin, calcium carbonate, magnesium carbonate, titanium oxide, zinc oxide, silicon oxide, aluminum hydroxide, ureaformalin resin, etc.

In addition, there may be incorporated, for purpose of preventing head abrasion, prevention of sticking, etc., higher fatty acid metal salts such as zinc stearate, calcium stearate, etc.; waxes such as paraffin, oxidized paraffin, polyethylene, oxidized polyethylene, stearic amide, castor wax, etc.; dispersing agents such as sodium dioctylsulfosuccinate, etc.; UV absorbing agents of benzophenone type, benzotriazole type, etc. and further surface active agents, fluorescent dyes, etc., if necessary and desired.

As the substrate used in the present invention, paper is mainly used. Non-woven cloth, plastic films, synthetic papers, metal foils and the like or composite sheets obtained by combining these may optionally be employed. Various well-known techniques in producing thermosensitive recording materials such as preparing an overcoat layer for protecting thermosensitive recording layers or preparing an undercoat layer comprised of single or plural layers of pigment or resin between the thermosensitive layer and the substrate.

EXAMPLES

Next, the present invention will be described in more detail by referring to the examples.

Parts and % shown below are all by weight.

EXAMPLE 1

Preparation of Thermosensitive Recording Materials (1) Preparation of Thermosensitive Coating Composition A dye dispersion was obtained by milling for 24 hours in a ball mill 30 parts of a dye precursor 3-dibutylamino-6-methyl-7-anilinofluoran with 120 parts of 2.5% aqueous solution of polyvinyl alcohol. Then a dye developer dispersion was obtained by milling for 24 hours in a ball mill 40 parts of 2,2-bis(p-hydroxyphenyl)propane with 160 parts of 2.5% aqueous solution of polyvinyl alcohol. A dispersion of the present compound was obtained by milling for 24 hours in a ball mill, 10 parts of a compound represented by the formula (1) with 30 parts of 2.5% aqueous solution of polyvinyl alcohol.

A thermosensitive coating composition was prepared by mixing the three dispersions above described and mixing sufficiently the resulting mixture and adding the following composition under stirring.

50% calcium carbonate dispersion:60 parts
40% zinc stearate dispersion:25 parts
10% polyvinyl alcohol aqueous solution:40 parts
Water250 parts (2) Preparation of Coating Paper for Thermosensitive Recording Materials A coating composition mixed of the following composition was coated onto a base paper (substrate) weighing 40 g/m$^2$ at 6 g/m$^2$ coverage as solid body and then dried to prepare a coating paper for thermosensitive recording materials.

Calcined kaolin:100 parts
Styrene-butadiene copolymer
latex (50% aqueous dispersion):24 parts
10% polyvinyl alcohol aqueous solution:40 parts
Water:68 parts (3) Preparation of Thermosensitive Recording Material The thermosensitive coating composition prepared in (1) was coated onto the coating paper for thermosensitive recording materials at 3 g/m$^2$ as solid body and then dried to prepare a thermosensitive recording material.

EXAMPLE 2

A thermosensitive recording material was prepared similarly to Example 1 with the exception that the compound represented by the formula (1) was replaced by the compound represented by the formula (2).

EXAMPLE3

A thermosensitive recording material was prepared in a way similar to that of Example 1 with the exceptions that the compound represented by the formula (1) was replaced by the compound represented by the formula (4).

EXAMPLE 4

A thermosensitive recording material was prepared in a way similar to that of Example 1 with the exception that the compound represented by the formula (1) was replaced by the compound represented by the formula (5).

COMPARATIVE EXAMPLE 1

A thermosensitive recording material was prepared in a way similar to that of Example 1 with the exception that the compound represented by the formula (1) was removed.

EVALUATION

The thus prepared thermosensitive recording materials obtained by Examples 1–4 and Comparative Example 1 were treated by supercalendering so as to have them complied with a Beck's degree of smoothness varied between 400 and 500 seconds. And these materials were printing-tested using TH-PMD facsimile test machine manufactured by Okura Electric Co., Ltd. Printing was performed using a thermal head having a dot density of 8 dots/mm and head resistance of 185 ohm, at a head voltage of 12 V, for a pulse width of 0.6 and 0.8 ms. Recording density was measured with Macbeth RD-918 reflection densitometer.

These results are shown in Table 1.

TABLE 1

| | Optical density of image pulse width (ms) | |
|---|---|---|
| | 0.6 | 0.8 |
| Example 1 | 1.29 | 1.45 |
| Example 2 | 1.14 | 1.42 |
| Example 3 | 1.08 | 1.39 |
| Example 4 | 0.89 | 1.38 |
| Comparative Example 1 | 0.70 | 1.18 |

As is evident from the results of Table 1, thermosensitive recording materials having excellent thermal response and high color developing sensitivity could be obtained by incorporation of the compound of the present invention into thermosensitive recording materials.

While the invention has been particularly shown and described with reference to preferred embodiments thereof, it will be understood by these skilled in the art that various changes and modifications can be made therein without departing from the spirit and the scope of the present invention.

What is claimed is:

1. A thermosensitive recording material comprising an underlying substrate, an ordinarily colorless or slightly colored dye precursor, an electron receptive compound (developer) coloring said dye precursor by reacting when heated, and a compound of following general formula (I)

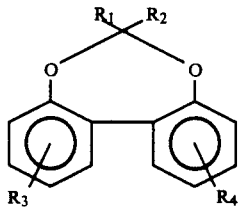

(I)

wherein $R_1$ and $R_2$ each represents hydrogen atom, alkyl, alkenyl or aryl group, and $R_1$ and $R_2$ may be different from each other; $R_1$ and $R_2$ may also be linked together to form cycloalkyl, cycloether, $R_3$ and $R_4$ each represents hydrogen atom, alkyl, alkenyl, alkoxy or aryl group and halogen atom, and $R_3$ and $R_4$ may be different from each other.

2. A thermosensitive recording material of claim 1, wherein a compound of said general formula is added to the developer in an amount of 5 percent by weight to 400 percent by weight, based on the weight of the developer.

3. A thermosensitive recording material of claim 2, wherein a compound of said general formula is added to the developer in an amount of 20 percent by weight to 300 percent by weight, based on the weight of the developer.

4. A thermosensitive recording material of claim 1, wherein a compound of said general formula is a compound having a melting point range between 60° C. and 160° C.

5. A thermosensitive recording material of claim 1, wherein said leuco dye is 3-dibutylamino-6-methyl-7-anilinofluoran; and said electron receptive compound is 1,1-bis(p-hydroxyphenyl)propane.

6. A thermosensitive recording material of claim 5, wherein one compound selected from the group consisting of

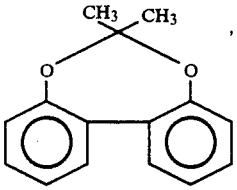

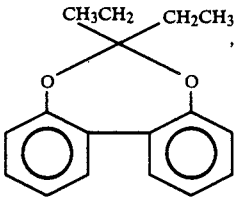

-continued

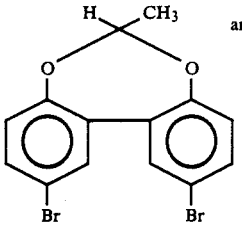

and

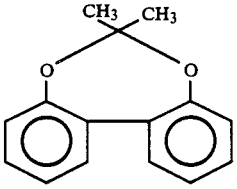

is contained as said compound of the general formula (I).

7. A thermosensitive recording material of claim 1, wherein the compound of the general formula is a compound selected from the group consisting of

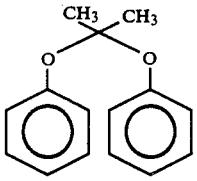

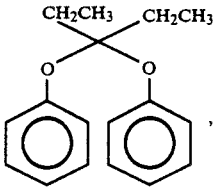

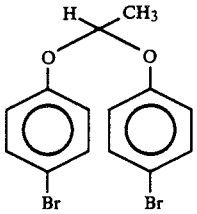

and

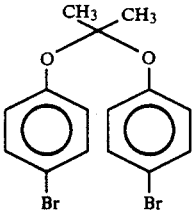

* * * * *